United States Patent [19]

Johnson et al.

[11] Patent Number: 5,015,148

[45] Date of Patent: May 14, 1991

[54] LOADER MOUNTING FRAME

[75] Inventors: Russell I. Johnson, Leonard; Daniel D. Radke, Troy, both of Mich.; Garry L. Ball, Lancaster, Pa.

[73] Assignee: Ford New Holland, Inc., New Holland, Pa.

[21] Appl. No.: 570,482

[22] Filed: Aug. 21, 1990

Related U.S. Application Data

[63] Continuation of Ser. No. 300,019, Jan. 23, 1989, abandoned.

[51] Int. Cl.[5] ..... E02F 3/38

[52] U.S. Cl. ..... 414/722; 414/715

[58] Field of Search ..... 172/776

[56] References Cited

U.S. PATENT DOCUMENTS

| | | | |
|---|---|---|---|
| 3,172,553 | 3/1965 | McCanse | 414/715 |
| 3,570,691 | 3/1971 | Guinot | 414/715 X |
| 3,902,295 | 9/1975 | Yancey | 414/715 X |
| 4,153,167 | 5/1979 | Gill | 414/727 X |
| 4,175,907 | 11/1979 | Knell et al. | 414/715 |
| 4,230,435 | 10/1980 | Azevedo | 414/722 |
| 4,352,626 | 10/1982 | Frisbee et al. | 414/722 |
| 4,439,089 | 3/1984 | Anderson et al. | 414/722 |
| 4,531,883 | 7/1985 | Arnold | 414/722 |
| 4,576,543 | 3/1986 | Kuchyt et al. | 414/722 |

OTHER PUBLICATIONS

Ford Specifications 555B, Brochure.

*Primary Examiner*—Robert J. Spar
*Assistant Examiner*—William M. Hienz
*Attorney, Agent, or Firm*—Larry W. Miller; Frank A. Seemar; Darrell F. Marquette

[57] ABSTRACT

A mounting frame for use with a tractor loader is disclosed wherein the main support arms extend generally linearly from the rear pivot mounting thereof with the tractor to the front pivot mounting with the loader bucket. The thickest portion of the main support arm is positioned immediately rearwardly of the transverse torque tube interconnecting the laterally spaced main support arms. Each main support arm decreases in size from this intermediate portion toward the forward and rearward pivots. The main support arm is generally symmetrical about a straight line interconnecting the forward and rearward pivots.

8 Claims, 2 Drawing Sheets

LOADER MOUNTING FRAME

This application is a continuation, of application Ser. No. 07/300,019, filed Jan. 23, 1989, now abandoned.

BACKGROUND OF THE INVENTION

The present invention relates generally to tractor loader backhoes having a loading mechanism operatively positioned forwardly of the tractor and, more particularly, to a mounting frame operably attaching the bucket loader to the tractor.

Typically, the mounting frames for the front end loader on a tractor loader backhoe have main support arms formed in a dog-leg shape such as shown in U.S. Pat. No. 4,531,883. Typically, the thickest cross-sectional configuration of the main support arm is positioned intermediate the ends of the support arm at the bend thereof. Furthermore, the connections of the hydraulic cylinders to actuate movement of the support arms relative to the tractor and of the bucket relative to the support arms are usually connected at this intermediate bent portion of the main support arms.

It would be desirable to provide a mounting frame to pivotally attach a working tool such as a loader bucket forwardly of a tractor utilizing main support arms having a more efficient structural configuration so that the main support arm can be manufactured more easily and will have less weight without sacrificing strength or structural integrity.

SUMMARY OF THE INVENTION

It is an object of this invention to overcome the aforementioned disadvantages of the prior art by providing an improved mounting frame for a tractor loader.

It is an object of this invention to construct the main support arms for a tractor loader mounting frame such that the largest cross-sectional configuration of the support arm is positioned immediately rearwardly of the torque tube interconnecting the laterally spaced main support arms.

It is a feature of this invention that the cross-sectional configuration of each main support arm decreases in size from the intermediate portion toward both the forward and rearward pivotal connections.

It is an advantage of this invention that the main support arms can be manufactured with less material without sacrificing strength or structural integrity.

It is another feature of this invention that the main support arms are generally symmetrical about a line interconnecting the forward and rearward pivots.

It is another advantage of this invention that the manufacture of the main support arms in simplified.

It is another object of this invention to provide a pivotal linkage interconnecting the main support arms and the loader bucket for connection with a hydraulic cylinder to control the pivotal movement of the loader bucket relative to the support arms.

It is still another feature of this invention that the pivot linkage is connected to the main support arms between the intermediate portion and the forward pivotal connection with the loader bucket.

It is a further object of this invention to provide a mounting frame for a tractor mounted bucket loader which is durable in construction, inexpensive of manufacture, carefree o maintenance, facile in assemblage, and simple and effective in use.

These and other objects, features and advantages are accomplished according to the instant invention by providing a mounting frame for use with a tractor loader wherein the main support arms extend generally linearly from the rear pivot mounting thereof with the tractor to the front pivot mounting with the loader bucket. The thickest portion of the main support arm is positioned immediately rearwardly of the transverse torque tube interconnecting the laterally spaced main support arms. Each main support arm decreases in size from this intermediate portion toward the forward and rearward pivots. The main support arm is generally symmetrical about a straight line interconnecting the torward and rearward pivots.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF PREFERRED EMBODIMENT

Figure 1:
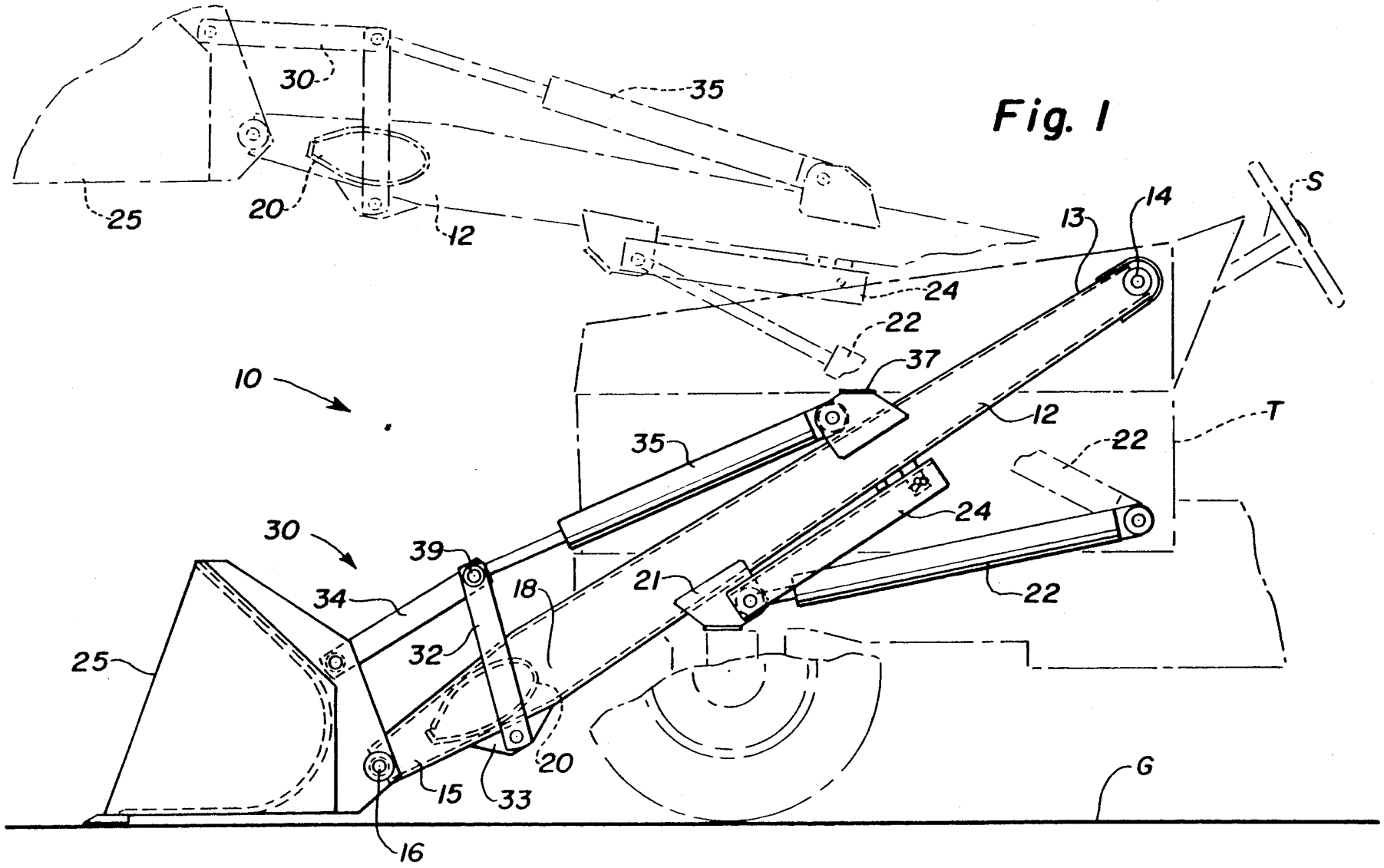
FIG. 1 is a side-elevational view of the mounting frame incorporating the principles of the instant invention, the representative tractor to which the mounting frame would be pivotally attached in shown in phantom, a representative pivotal movement of the mounting frame and loader bucket also being shown in phantom.

Referring now to the drawings, a left side-elevational view and a top plan view of the tractor loader mounting frame can be seen. Any left and right references are used as a matter of convenience and are determined by standing behind the steering wheel S of the tractor shown in phantom looking forwardly toward the loader bucket 25.

The mounting frame 10 includes a pair of laterally spaced main support arms 12 positioned on opposing sides of the tractor T and interconnected by a transversely extending torque tube 20 positioned forwardly of the tractor T to resist torsional forces exerted by the operation of the loader bucket 25. Although the loader bucket 25 is depicted in the drawings, other working tools such as a forklift could be equally utilized. Each main support arm 12 includes a rearward portion 13 carrying a pivot 14 connected to the, tractor T to provide a center of pivotal movement of the mounting frame 10. The main support arms 12 also include a forward end 15 carrying a second pivot 16 for connection to the loader bucket 25 to pivotally support the loader bucket 25 for operative movement relative to the main support arms 12.

The main support arms 12 also include an intermediate portion 18 located immediately rearwardly of the torque tube 20 at which the greatest cross-sectional configuration of the main support arms 12 can be found. The configuration of the main support arms 12 is generally symmetrical about a line extending between the rearward and forward pivots 14, 16 with the size of the cross-sectional configuration decreasing from the intermediate portion 18 immediately rearwardly of the torque tube 20 toward both the rearward end 13 and the forward end 15.

The main support arms 12 are also provided with a mounting bracket 21 to which is connected a hydraulic cylinder 22 extending from a pivotal connection with the tractor T such that the extension of the hydraulic cylinder 22 will effect a pivotal movement of the mounting frame 10 about the rearward pivot 14 on the main support arms 12. A mechanical lockout 24 is carried by the left main support arm 12 to be selectively engagable with the hydraulic cylinder 22 after it has been extended to position the mounting frame 10 in the position such as indicated in phantom in FIG. 1 to mechanically lock the retraction of the hydraulic cylinder 22 in a manner conventional in the art.

The mounting frame 10 also includes a pivot linkage 30 interconnecting the main support arms 12 and the loader bucket 25 to control the pivotal movement of the loader bucket 25 about its pivotal connection 16 to the main support arms 12. The pivot linkage 30 includes a first link 32 pivotally connected to a bracket 33 affixed to the main support arms 12 beneath the transverse line of the torque tube 20 between the intermediate portion 18 and the forward end 15. The pivot linkage 30 also includes a second link 34 pivotally connected to the loader bucket 25 at a position above the pivot 16 and extending rearwardly therefrom to pivotally connect to the first link 32 by a pivot 39.

Figure 2:
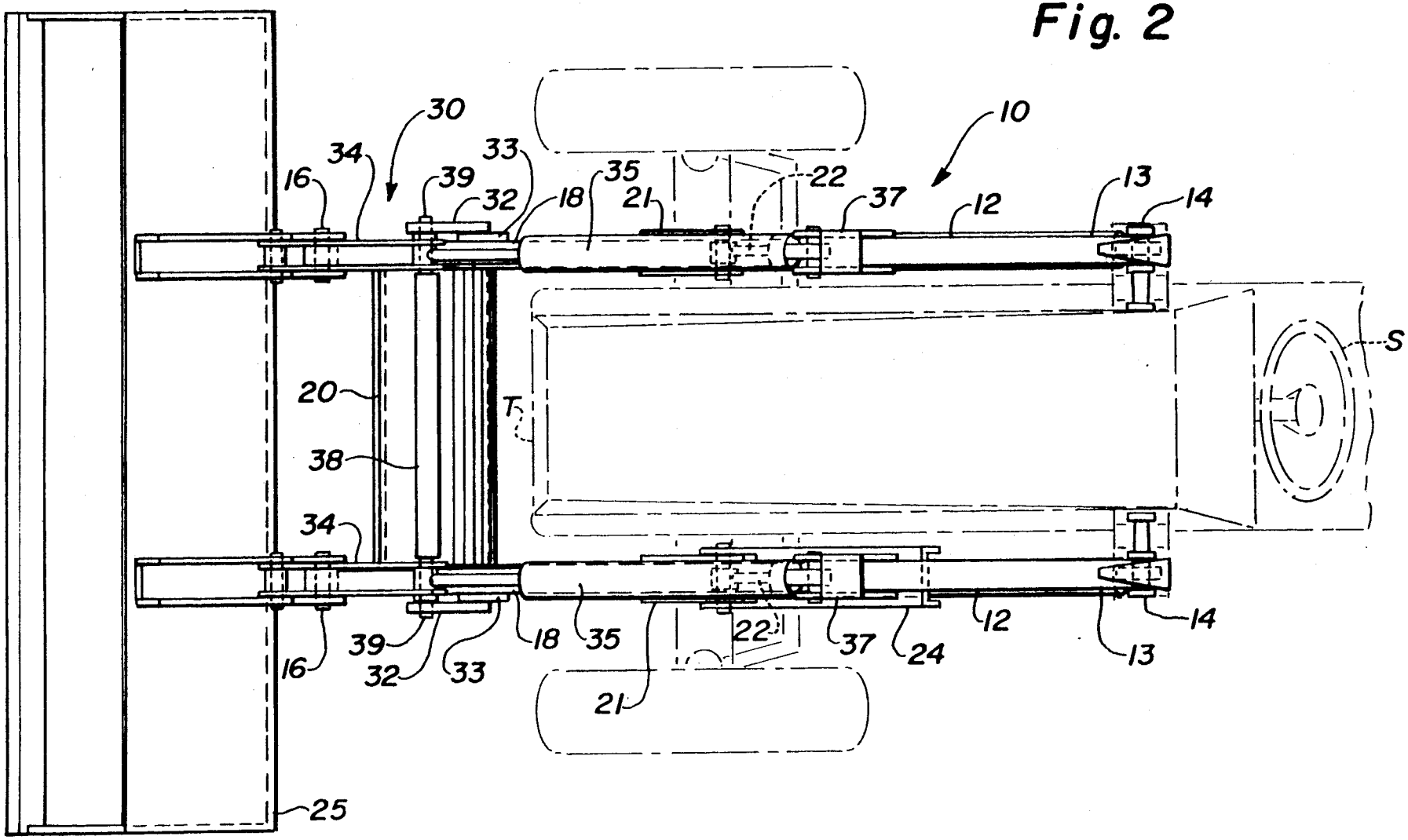
FIG. 2 is a top plan view of the tractor loader mounting frame connected to a loader bucket shown in FIG. 1 with the representative tractor being shown in phantom.

A second hydraulic cylinder 35 is attached to a bracket 37 affixed to the main support arms 12 between the intermediate portion 18 and the rearward end 13 and connects to the pivot linkage 30 at the pivot 39. The telescopic operation of the second hydraulic cylinder 35 controls the pivotal movement of the loader bucket 25 about the loader arm pivot 16. To stabilize the operation of the pivot linkage 30 a cross-bar 38 interconnects the pivots 39 corresponding to the left and right sides of the mounting frame 10 as best depicted in FIG. 2.

Because of the positioning of the greatest cross-sectional configuration at the intermediate portion 18 immediately rearwardly of the torque tube 20, the stresses imposed in the main support arms 12 from the operation of the loader bucket 25 can be adequately accommodated without the addition of further material between the intermediate portion 18 and the rearward end 13 as is typical in prior art tractor loader mechanisms. Accordingly, the size of the mounting frame 10 can be reduced without sacrificing strength or operational characteristics. Reference to the greatest cross-sectional configuration above takes into consideration the height of the support arms 12 at the intermediate portion 18, which decreases from the intermediate portion to both the rearward end 13 and the forward end 15. This greatest height dimension is determined from a view of the support arm 12 transversely of the mounting frame 10 in an elevational sense as seen in FIG. 1 with the support arms 12 extending generally horizontally.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention: however, concepts, as based upon the description, may be employed in other embodiments without departing from the scope of the invention. Accordingly, the following claims are intended to protect the invention broadly as well as in the specific form shown.

What is claimed is:

1. In a mounting frame adapted to be pivotally connected to a tractor and for detachably supporting a working tool in an operative position forwardly of said tractor, said mounting frame having a pair of main support arms positioned, respectively, on opposing sides of said tractor, each said main support arm having a rearward end pivotally connectable to said tractor and a distal forward end pivotally connectable to said working tool for operable support thereof, wherein each said main support arm is generally symmetrical about a straight line interconnecting said forward and rearward ends as seen from an elevational viewpoint transversely from said tractor, said mounting frame further having a torque tube extending transversely between said main support arms forwardly of said tractor, said tractor having a pair of hydraulic cylinders interconnecting, respectively, said main support arms at mounting points, located between said rearward end and said forward end, and said tractor to power a pivotal movement of said main support arms about said rearward ends, improved main support arms comprising:

each said main support arms including an intermediate portion located between said forward end and the corresponding said mounting point, said intermediate portion having the the greatest height of said main support arm and being positioned immediately rearwardly of said torque tube, the cross-sectional configuration of said main support arm decreasing in size from said intermediate portion to both said rearward end and said forward end.

2. The mounting frame of claim 1 further comprising a pivot linkage interconnecting each said main support arm and said working tool to control the pivotal movement of said working tool about the pivotal connection thereof with the forward end of said main support arm.

3. The mounting frame of claim 2 wherein said pivot linkage includes a pair of first links pivotally connected to corresponding said main support arms forward of said intermediate portion and a pair of second links pivotally connected to said working tool and extending rearwardly for pivotal interconnection with corresponding said first links.

4. The mounting frame of claim 3 wherein said pivot linkage is connected to a pair of second hydraulic cylinders respectively mounted on said main support arms to effect movement of said pivot linkage and an associated pivotal movement of said working tool.

5. The mounting frame of claim 4 wherein at least one of said main support arms carries a lockout device engageable with the corresponding said first hydraulic cylinder to lock said corresponding first hydraulic cylinder in an extended position.

6. A mounting frame pivotally interconnecting a tractor and a working tool for operably supporting said working tool forwardly of said tractor, comprising:

a pair of laterally spaced apart longitudinally extending main support arms positionable on opposing sides of said tractor, each said main support arm having a rearward end carrying a first pivot for pivotally connecting said main support arm to the respective side of said tractor and a distal forward end adapted for pivotal connection to said working tool forwardly of said tractor, each said main support arm further having an intermediate portion having the largest height of said main support arm, the size of the cross-sectional configuration of said main support arm decreasing from said intermediate portion to both said forward and rearward ends, each said main support arm having a mounting point connectable to a hydraulic cylinder fastened to said tractor to power pivotal movement of said mounting frame about said rearward ends, said intermediate portion being located between the corresponding said mounting point and the corresponding said forward end, wherein each said main support arm is generally symmetrical about a transversely extending plane defining a straight line interconnecting said forward and rearward ends as seen from an elevational viewpoint transversely from said tractor;

a transverse torque tube interconnecting said main support arms forwardly of said tractor, said intermediate portion being located immediately rearwardly of said torque tube; and a pivot linkage interconnecting said main support arms and said working tool about the forward ends of said main support arms.

7. The mounting frame of claim 6 wherein said pivot linkage includes a pair of first links pivotally connected to corresponding said main support arms forwardly of said intermediate portion and a pair of second links pivotally connected to said working tool and extending rearwardly therefrom for pivotal connection to the corresponding said first links.

8. The mounting frame of claim 7 wherein said pivot linkage is connected to a pair of second hydraulic cylinders respectively mounted on said main support arms to effect movement of said pivot linkage and an associated pivotal movement of said working tool.

* * * * *